United States Patent [19]

Feingold et al.

[11] 4,177,305

[45] Dec. 4, 1979

[54] WALL HANGING

[76] Inventors: David A. Feingold; Susan R. Feingold, both of 2111 Glen Flora, Waukegan, Ill. 60085

[21] Appl. No.: 931,426

[22] Filed: Aug. 7, 1978

[51] Int. Cl.[2] ..... B44F 11/04

[52] U.S. Cl. ..... 428/13; 35/27; 52/390; 52/DIG. 4; 52/DIG. 13; 273/157 R; 428/47; 428/100; 428/900

[58] Field of Search ..... 35/27–28; 273/157 R; 428/13–14, 47, 48, 49, 900, 100; 52/384–390, DIG. 4, DIG. 13; 156/71; 40/158 A

[56] References Cited

U.S. PATENT DOCUMENTS

| | | | |
|---|---|---|---|
| 2,825,166 | 3/1958 | Flood | 40/158 A |
| 3,121,977 | 2/1964 | Bersudsky | 52/385 X |
| 3,193,434 | 7/1965 | Weiss | 428/178 X |
| 3,242,594 | 3/1966 | Smith | 428/14 X |
| 3,378,974 | 4/1968 | Bush, Jr. | 52/483 |
| 3,561,146 | 2/1971 | Dembar | 428/13 X |
| 3,703,431 | 11/1972 | Kemper | 428/47 X |
| 3,721,050 | 3/1973 | Perina | 52/28 |
| 3,775,153 | 11/1973 | Greenberg et al. | 428/49 X |
| 3,873,096 | 3/1975 | Shoptaugh | 273/157 R X |
| 3,875,716 | 4/1975 | Eusemann | 428/49 X |
| 3,999,761 | 12/1976 | Daniels | 273/293 |

*Primary Examiner*—Henry F. Epstein
*Attorney, Agent, or Firm*—Dressler, Goldsmith, Clement, Gordon & Shore, Ltd.

[57] ABSTRACT

A wall hanging having a variable picture made of a multitude of interchangeable tiles which snap-fit onto a specially configured picture support assembly. A frame decoratively surrounds and contains the tiles. Each of the tiles has an eccentric image or eccentric geometric pattern thereon and can be rotated on a peg to various positions to attain a variety of pictures. Even more pictures can be obtained when different patterned tiles are exchanged with each other. In one embodiment, the tiles and pegs are rectangular and the pegs have a concave corner to facilitate removal of the tiles. In another embodiment, the faces of the tiles are circular and rotate upon cylindrical pegs. The tiles can also be transparent with window-like pockets that receive reversible decorative members.

22 Claims, 10 Drawing Figures

WALL HANGING

BACKGROUND OF THE INVENTION

This invention relates to a decorative assembly, and more particularly, to a wall hanging with a variable picture.

Over the years a number of decorative assemblies have been developed with variable displays. Typical of such decorative assemblies are those found in U.S. Pat. Nos. Re. 19,238; 553,533; 1,492,671; 1,516,264; 2,105,008; 2,273,567; 2,280,609; 2,338,426; 2,592,078; 3,014,302; 3,281,966; 3,680,227; 3,768,177 and 3,987,558. These decorative assemblies have met with varying degrees of success.

For example, the Tsukamoto U.S. Pat. No. 3,987,558 discloses a block-built picture which is formed from a multitude of six-sided cubes. Collectively, the cubes are quite massive and heavy, particularly when made of wood. These characteristics make the Tsukamoto picture very cumbersome and difficult to hang on a wall. Furthermore, the Tsukamoto picture is quite thick because of the cubic nature of the blocks, which deters from the decorative appearance of the picture. Each of the six sides or faces of the blocks have a concentric dot thereon. The dots are of different diameters. By presenting a different side of the cube for viewing, different dot-like pictures can be formed. In another embodiment, Tsukamoto utilizes a tapered or triangular-shaped pictoral element on curved portions of cylindrical blocks to form a multitriangular picture.

Williamson U.S. Pat. No. 2,280,609 shows a puzzle and game in which rectangular tiles are held by the cylindrical posts of a game board. No provision is made for displaying the puzzle on a wall or for readily removing the tiles. Because the tiles are substantially solid, with only a small cylindrical recess thereon, the game board can become quite heavy when a great number of tiles are used.

Bruel U.S. Pat. No. 1,492,671 discloses a building block set formed of cubic and rectangular six-sided block. The rectangular blocks have their lengths oriented either longitudinally or laterally and are of different size than the cubic blocks. Each face of the cubic and rectangular blocks have a design in contrasting colors. By presenting different sides of the blocks for viewing, different pictures can be obtained. Because of the six-sided nature of the blocks, the set can be quite thick and heavy and no provision is made for displaying and holding the building block set on a wall.

It is therefore desirable to provide an improved decorative assembly which overcomes most, if not all, of the preceding problems.

SUMMARY OF THE INVENTION

An improved decorative assembly and wall hanging is provided that is attractive, lightweight, thin and inexpensive to manufacture. The wall hanging provides a variable ornamental picture made of a multitude of interchangeable tiles which are supported by a specially confined picture support assembly that is hung on a wall to display the variable picture.

In accordance with principles of the present invention, the tiles are positioned adjacent each other in a longitudinal and lateral array and have complementary configurations. Each tile has a single thin walled viewable picture surface that is generally flat or planar and faces forwardly towards an observer. A thin walled skirt extends rearwardly from the peripheral edge of the viewable picture surface at a distance (defining the overall thickness of the tile) substantially less than minimum the lateral distance across the viewable picture surface. At least one eccentric geometric pattern or image is positioned adjacent the viewable picture surface at a location spaced away from and geometrically offset from the geometric center of the viewable picture surface.

Desirably, each of the tiles can be rotated on a peg to a variety of positions to attain different pictures. Even more pictures can be attained when different patterned tiles are exchanged with each other.

In the preferred embodiment, each tile defines a rearwardly facing socket that has a lateral cross-sectional area slightly less than the surface area of the front face of the viewable picture surface. The lateral shape and configuration of the socket is similar to the shape and configuration of the viewable picture surface. Each socket snap fits onto a peg of the picture support assembly.

In order to minimize the weight and amount of material needed to fabricate and mold the tiles and thereby decrease manufacturing costs, the minimum distance across the socket is substantially greater than the wall thickness of both the skirt and the viewable picture surface.

The picture support assembly includes a generally flat or planar blocking surface which is covered by and positioned rearwardly of the selectively variable picture. When the tiles are assembled, the backing surface lies generally parallel to the viewable picture surfaces and abuts against and supports the rearward edges of the tiles.

Pegs extend forwardly from the backing surface, towards the viewable picture surfaces, and are aligned in registration with the sockets of the tiles.

Desirably, the pegs have a configuration which are complementary and generally similar to the configuration of the tiles. In the illustrative embodiments, each of the pegs has a front surface and a side wall that extends between and connects the front surface to the backing surface. When assembled, the side walls slidably and telescopically engage the skirts of the tiles and extend forwardly to a position closely adjacent the viewable picture surfaces, and the front surface of the pegs are positioned parallel to and rearwardly of the viewable picture surfaces of the tiles. In order to maximize the surface and support area of the pegs, the front surface of the pegs are generally flat or planar and span a distance substantially greater than the forward distance of the side walls of the pegs.

A frame is connected to and extends outwardly of the picture support assembly to decoratively surround and contain the selectively viewable picture. Fastening means, such as one or more strips of self-sticking tape, and secured to the back of the picture support assembly or the frame to mount the picture upon a wall.

In one embodiment, the tiles and pegs are generally rectangular to effectively eliminate longitudinal and lateral movement of the assembled tiles and the pegs each have a concave corner that provides an arcuate fulcrum to facilitate removal of the tiles. The corners of the rectangular tiles include a manually depressible corner that covers the concave corner of the peg. When the manually depressible corner is depressed towards the backing surface, the tile will pivotally engage the arcuate fulcrum until the tile snaps off its associated peg.

In another embodiment the tiles and pegs are cylindrical with generally flat, or planar, circular viewable picture surfaces. Desirably, the cylindrical tiles are spaced apart from each other to permit the tiles to freely rotate upon the pegs to attain different pictures.

In one preferred form, the viewable picture surfaces of the tiles are transparent and provide window-like protective coverings for viewing a decorative member that is positioned or sandwiched between the front surface of the peg and the back surface of the transparent picture surface. Desirably, the decorative member has a shape and configuration generally similar to the transparent picture surface and when assembled, lies parallel to the transparent picture surface. The decorative member has at least one viewable decorative surface, that faces towards the transparent picture surface, with at least one eccentric geometric pattern or image positioned thereon. In the preferred embodiment, the decorative member is removable and reversible with front and back decorative surfaces which can be reversed as desired.

In other embodiments Velcro-typed fasteners, magnets or triangular pockets are used in lieu of pegs and sockets.

A more detailed explanation of the invention is provided in the following description and appended claims taken in conjunction with the accompanying drawings.

DETAILED DESCRIPTION OF THE ILLUSTRATIVE EMBODIMENT

Figure 1:
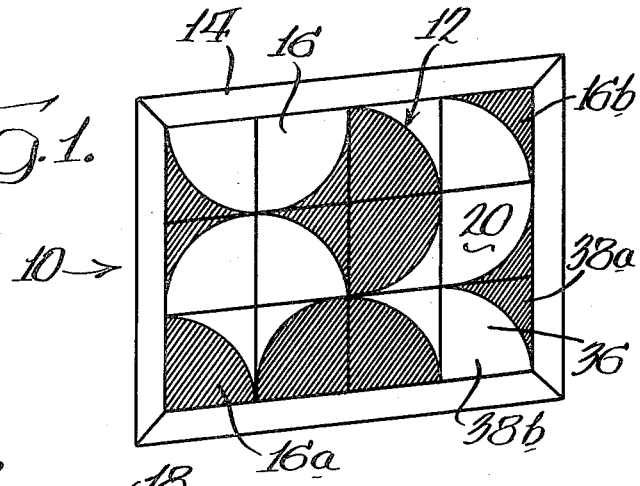
FIG. 1 is a perspective front view of a wall hanging in accordance with principles of the present invention.

FIG. 1 illustrates a wall hanging and decorative assembly 10 which has a selectively variable picture 12 made of a plurality of rectangular movable tiles or modules 16 that are positioned generally adjacent each other in a longitudinal and lateral array. Tiles 16 are decoratively surrounded, contained, and bordered by a frame 14. Frame 14 also assists in restraining longitudinal and lateral movement of tiles 16.

Tiles 16 are of the same size and shape and are made of impact-resistant plastic. Other materials can be used, if desired. In the illustrative embodiment, there are three horizontal rows and four vertical columns of tiles 16. Each row has four tiles positioned in side-by-side relationship and each column has three tiles positioned in an end-to-end relationship. Pictures having different numbers of rows or columns of tiles can also be utilized. In use, tiles 16 are interchangeable with each other. For example, the tile **16*a* in the lower left-hand corner can be moved and exchanged with the tile 16*b* in the upper right-hand corner of the picture 12**.

Figure 2:
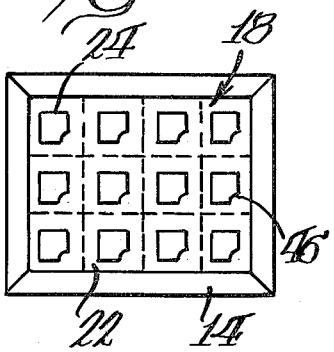
FIG. 2 is a front view of the wall hanging with the tiles removed.

As best shown in FIG. 2, frame 14 is connected to and extends outwardly from a picture support assembly 18. In the illustrative embodiment the outer edges of frame 14 are positioned in lateral alignment with the front surfaces or viewable picture surfaces 20 of tiles 16 (FIG. 1). Frame 14 is made of lightweight decorative plastic, although light-weight wood or other materials can be used if desired. In some circumstances, it may be desirable that frame 14 extend forwardly of the viewable picture surface 20 of tile 16.

Figure 3:
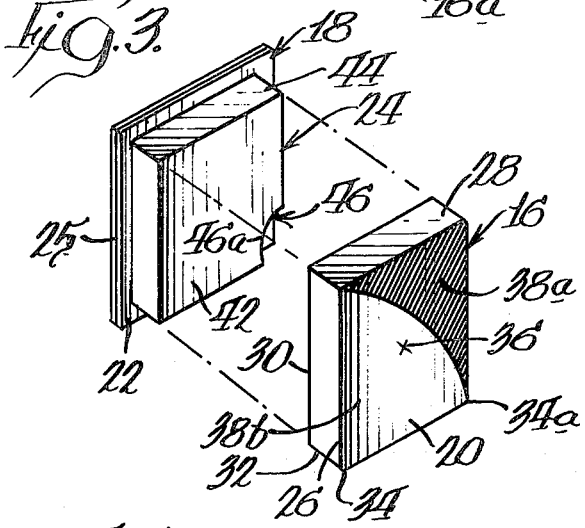
FIG. 3 is an enlarged, exploded perspective view of one of the tiles and pegs of the wall hanging.
Figure 4:
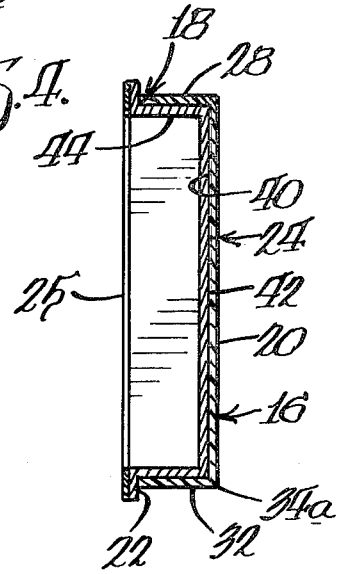
FIG. 4 is a cross-sectional side view of one of the tiles mounted on a peg.

Picture support assembly 18 (FIG. 2) securely holds and supports tiles 16, comprising picture 12, on a wall. When hung, picture support assembly 18 is positioned rearwardly of picture 12 against the wall and is generally covered by picture 12. Structurally, picture support assembly 18 has a generally planar or flat backing surface 22 and an array of tile supporting pegs 24 that extend forwardly from the backing surface or member 22 to interlockingly, snap-fittingly and telescopically engage and support tiles 16. In the embodiment of FIGS. 1–4, pegs 24 are generally rectangular to substantially prevent longitudinal and lateral movement of tiles 16. FIG. 3 illustrates one of the tiles 16 prepatory to being mounted on peg 24 of picture support assembly 18. FIG. 4 illustrates one of the tiles 16 detachably secured and engaging a peg 24.

In order to mount or hang the wall hanging 10 on a wall, one or more strips of pressure-sensitive tape 25, such as self-sticking two way adhesive tape, is attached to the back side of picture support assembly 18. Other fastening means, such as a hook or hanging wire can be used in lieu of tape 25 on the back side of the picture support assembly 18 or frame 14.

While the decorative assembly 10 is preferably used as a wall hanging in homes, offices, schools, etc., in some circumstances it may be desirable to use the decorative assembly 10 for other purposes, such as in a classroom as a teaching aid. For example, the decorative assembly can be placed upon an easel or a desk and used by the teacher as a variable chart. One or more other decorative assemblies may be used by students in the classroom to copy or simulate the teacher's chart. It may also be desirable in other environments to use numbers or letters instead of geometric patterns on the tiles.

In detail, each tile 16 (FIGS. 3 and 4) has a single thin walled viewable picture surface or front surface 20 which faces generally forwardly towards an observer. Viewable picture surface 20 is rectangular in shape and preferably square with a rectangular, and preferably square, peripheral edge 26. In the preferred form, viewable picture surface 20 is generally planar of flat, although in some circumstances it may be desirable that the viewable picture surface have a three-dimensional, irregular or curved contour. A side or thin walled skirt 28 extends rearwardly from peripheral edge 26 and has a rectangular cross-sectional configuration. Skirt 28 has four lateral edges 32 which define the rearward dimension of the skirt 28 and the thickness of the tile 16 and has an engageable rearward edge 30 that engages the backing surface 22 of picture support assembly 18. The length and width of the rectangular viewable picture surface 20 are each substantially greater than the thickness 32 of the tile 16.

The rectangular viewable picture surface 20 of each tile 16 has four corners 34 (FIG. 3) and a geometric center 36. The lower right-hand corner of each tile 16 provides a manually depressible and peg-engaging corner 34*a*.

A black geometric pattern or eccentric image 38*a* is painted on viewable picture surface 20 (at the upper right-hand corner of the tile 16 illustrated in (FIG. 3) at a location spaced away and geometrically offset from the geometric center 36. A white geometric pattern or eccentric image 38*b* is painted on the viewable picture surface 20 (at the left-hand corner of the picture tile illustrated in FIG. 3). Both geometric patterns 38*a* and 38*b* are generally triangular in shape with a curved or arcuate base, with the white geometric pattern 38*b* taking the form of a pie-shaped arcuate segment. Specifically, the black geometric pattern 38*a* has a concave base and the white geometric pattern 38*b* has a convex base. Other colors, shapes and designs can be used. In some circumstances, it may be desirable that geometric patterns 38*a* and 38*b* be integrally molded with picture surface 20 or glued or otherwise secured to the front of picture surface 20.

To vary the overall appearance and geometric design of picture 12, one or more tiles 16 can be temporarily removed from pegs 24 and rotated to one of four different 90 degree positions and thereafter snapped back on peg 24. For example, black geometric pattern 38*a* can be moved from the upper right-hand corner to the lower right-hand corner, or to the lower left-hand corner or the upper left-hand corner. It will be appreciated that a large number of different pictures 12 can be formed based on the various different combinations and permutations of the tiles 16 shown. It may be desirable that some of the tiles 16 have geometric patterns which are different from the geometric patterns of other tiles and in such circumstances the tiles 16 can be interchanged with each other to attain even more pictures.

In order to snugly and matingly engage and snap tiles 16 on pegs 24, each tile 16 is constructed and arranged to define a rearwardly facing socket 40 (FIG. 4) bounded by skirt 28 and viewable picture surface 20. Socket 40 has a generally rectangular cross-sectional area that is slightly less than the surface area of the front face of the viewable picture surface 20. The lateral (vertical) thickness of each wall of the thin walled skirt 28 is greatly shorter than both the lateral and longitudinal distance across socket 40, and the rearward thickness of the thin walled viewable picture surface 20 is substantially shorter than both the lateral and longitudinal distance across socket 40, in order to minimize the overall weight and amount of material needed to fabricate and mold tiles 16, so that tiles 16 are substantially hollow.

When the tiles 16 are installed, backing surface 22 is positioned parallel to the viewable picture surfaces 20 and supportingly engages the tiles' rearward edges 30. Pegs 24 extend forwardly from the backing surface 22 to a position closely adjacent the back of the viewable picture surfaces 20 so as to be telescopically aligned in registration with sockets 40 to support tiles 16.

Each of the pegs 24 has a generally rectangular front surface 42, as best shown in FIG. 3, and side walls 44 that extend between and connect the front surface 42 to the backing surface 22. The front surface 42 is generally planar or flat and has a length and a width that are substantially greater than the forward distance of side walls 44. Front surfaces 42 are positioned substantially parallel to and against viewable picture surfaces 20, and the side walls 44 slidably engage the interior surfaces of the skirt 28 within socket 40. The side walls 44 are generally rectangular in cross-section, as viewed from the front.

In order to facilitate removal of tiles 16, the front surface 42 and the side walls 44 of peg 24 are constructed and arranged to define a generally concave corner or cut-away portion 46 (FIG. 3) which is generally aligned and positioned rearwardly of the manually depressible corner 34*a* of tile 16 so as to be substantially covered by the manually depressible corner 34*a* of tile 16. Concave corner 46 has a curved or arcuate ledge 46*a* which provides an arcuate fulcrum. To remove tile 16 from peg 24, the manually depressible corner 34*a* of tile 16 is pushed or depressed toward backing surface 22 and moved into the void formed by the concave corner 46 of peg 24. Such action will cause tile 16 to pivotally engage arcuate corner 46*a* and pivot upon fulcrum 46*a*, until tile 16 "pops" off peg 24. Tile 16 can then be rotated to a different position in a manner previously described or exchanged with another tile, and subsequently inserted back onto peg 24.

Figure 5:
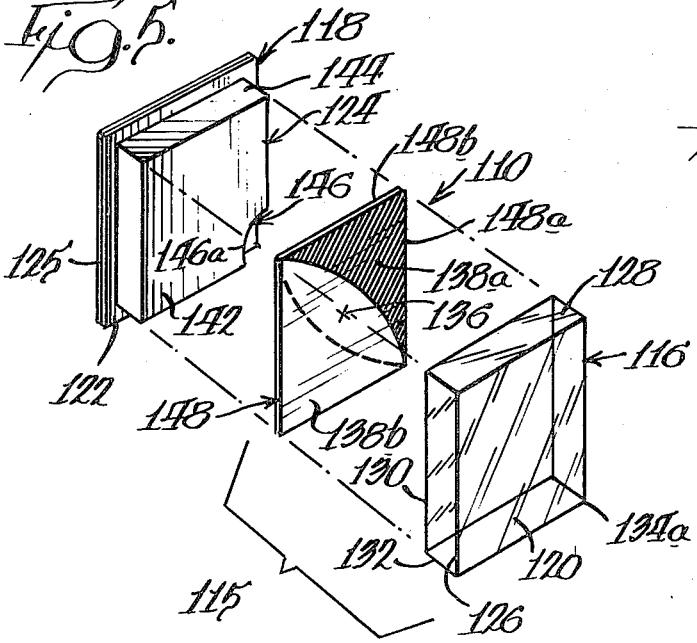
FIG. 5 is an exploded perspective view of a tile assembly and peg of another wall hanging in accordance with principles of the present invention.
Figure 6:
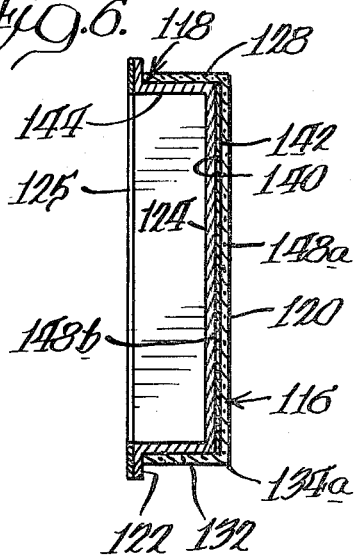
FIG. 6 is a cross-sectional side view of the tile assembly of FIG. 5 mounted on the peg.

Referring now to the wall hanging and decorative assembly 110 of FIGS. 5 and 6, wall hanging and decorative assembly 110 is very similar to the wall hanging and decorative assembly 10 shown in FIGS. 1–4, except that each tile assembly 115 has a tile 116 with a transparent window-like thin-walled viewable picture surface or protective covering 120 and a flexible decorative member 148 removably positioned in the pocket or socket 140 of the tile 112. For ease of understanding and comparison, similar parts and components of the wall hanging and decorative assembly 110 of FIGS. 5 and 6 have been given numbers similar to the corresponding parts and components of the wall hanging 10 of FIGS. 1–4, but increased by an amount of 100, such as peg 124, tiles 116,etc.

In detail, decorative member 148 is generally rectangular and made of metallic foil, although other materials, such as polyvinyl chloride, can be used. Preferably, decorative member 148 is reversible with a front viewable decorative surface 148*a*, generally facing the back of the transparent picture surface 120, and a back viewable decorative surface 148*b* normally facing the front surface 142 of peg 124. Each decorative surface 148*a* and 148*b* has geometric patterns or eccentric images 138*a* and 138*b* (similar to geometric patterns 38*a* and 38*b* of FIG. 3) eccentrically positioned thereon at locations generally spaced away and geometrically offset from the geometric center 136 of the decorative member 148.

In the illustrative enbodiment, the decorative member 148 is about the same size as the back of the transparent picture surface 120 and covers the back of the transparent picture surface 120. When assembled, the decorative member 148 lies generally parallel to the transparent picture surface 120 with the front surface 148*a* positioned against the back of the transparent picture surface 120 so as to be fully viewable through the picture surface 120.

When desired, the decorative member can be removed from pocket 140 and reversed, so that the back surface 148*b* of the decorative member 148 is snugly positioned against the transparent picture 120 for viewing.

Figure 7:
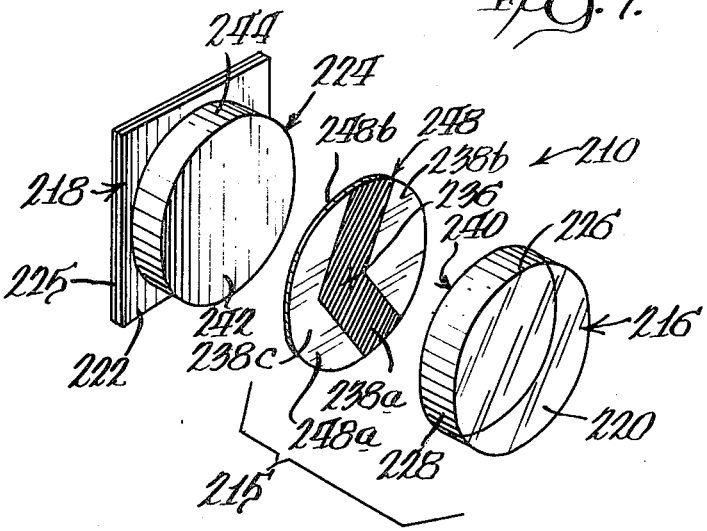
FIG. 7 is an exploded perspective view of a cylindrical tile assembly and peg of a further wall hanging in accordance with principles of the present invention.

The wall hanging and decorative assembly 210 of FIG. 7 is similar to the wall hanging decorative assembly 110 shown in FIGS. 5 and 6, except that each tile assembly 215 and peg 224 is generally cylindrical in shape to enable the tiles 216 to freely rotate upon pegs 224 in order to selectively vary the geometric design and picture of the wall hanging and decorative assembly 210. Cylindrical tiles 216 should be spaced slightly apart from each other to permit tiles 216 to freely rotate without interference. Structurally, each tile 216 has a circular, transparent, window-like thin-walled viewable picture surface or protective covering 220 facing forward, with a circumferential edge 226. An annular side or thin walled skirt 228 extends rearwardly from the circumferential edge 226 and cooperates with the picture surface to define a rearwardly facing socket or pocket 240 having a circular cross-section area (as viewed from the front) that is slightly less than the surface area of the front face of the picture surface 220. The diameter of the picture 220 is substantially greater than the rearward length of the skirt 228 (thicknees of the tile 216).

Each cylindrical peg 224 has a generally planar or flat circular front surface 242 and an annular side wall 244 that extends between and connects the front surface 242 to a generally planar or flat backing surface 222 of the picture support assembly 218. The diameter of front surface 242 is substantially greater than the forward distance of the annular side wall 244.

The circular decorative member 248 is reversible with eccentric geometric patterns or images 238*a*, 238*b* and 238*c* on both its front and back, viewable decorative surfaces 248*a* and 248*b*. The eccentric geometric patterns 238*a*, 238*b* and 238*c* are generally spaced away from and geometrically offset from the geometric center 236 of the decorative member 248. In the embodiment shown, the eccentric geometric patterns or images include a centrally positioned, black V-shaped geometric pattern or eccentric image 238*a*, a white arcuate segment or geometric pattern 238*b* (similar to geometric pattern 38*b* of FIG. 3), and a generally C-shaped white segment or geometric pattern 238*c*. Other eccentric geometric patterns, images and colors can be used.

In some circumstances, it may be desirable that the circular picture surface 220 be opaque with eccentric geometric patterns or images painted or secured thereon, similar to the embodiment of FIG. 3.

Figure 8:
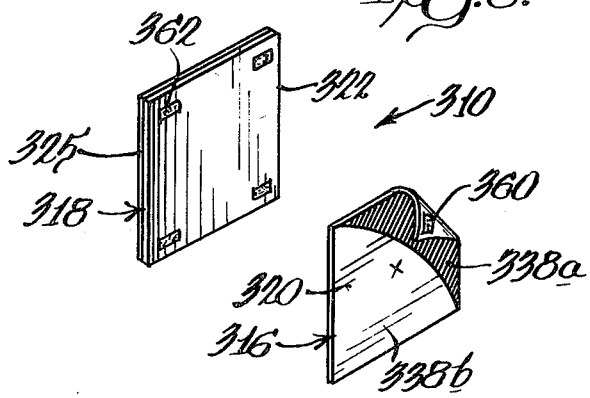
FIG. 8 is an exploded perspective view of a tile and backing member of another embodiment of the wall hanging, with one of the corners of the tile bent downwardly to illustrate a magnet that connects the tile to the backing member.

In FIG. 8, the decorative assembly or wall hanging 310 has generally flat or planar flexible tiles 316 with rectangular viewable picture surfaces 320 having eccentric geometric patterns or images 338*a* and 338*b* painted thereon. Magnets 360 and magnetically attractable metal segments 362 are attached to the backs of tiles 316 and the generally flat front backing surface 322, respectively, to magnetically connect the tiles 316 and backing surface 322 in lieu of having sockets and pegs. In the illustrative embodiment, each tile 316 has four magnets 360, one at each corner, and the picture support assembly 318 includes four metallic segments 362 per tile attached to the front face of the backing surface 322 and aligned in registration with the magnets 360.

In some circumstances, it may be desirable that the entire backing surface 322 be entirely made of a magnetically attractable metal so that separate metallic segments 362 need not be used. It may also be useful in some situations to make the tiles 316 out of rigid magnetically attractable metal and secure the magnets to the front face of the backing surface 322. Furthermore, the magnets 360 can be securely positioned and sandwiched between a pair of thin viewable picture surfaces so that the tiles are reversible.

Figure 9:
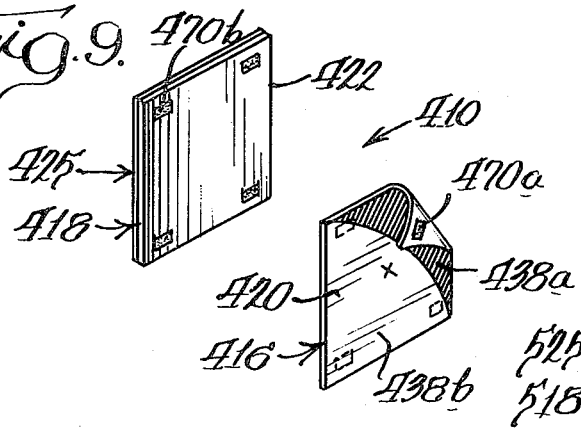
FIG. 9 is an exploded perspective view of a tile and backing member of another wall hanging, with one of the corners of the tile bent downwardly to depict a Velcro-type fastener that connects the tile to the backing member.

The wall hanging and decorative assembly 410 of FIG. 9 is substantially identical to the wall hanging and decorative assembly 310 of FIG. 8, except that Velcro-type fasteners 470*a* and 470*b* are used in lieu of magnets and magnetically attractable metallic segments 362. For ease of understanding and comparison, similar parts and components of the wall hanging and decorative assembly 410 shown in FIG. 9 have been given numbers similar to the corresponding parts and components of the wall hanging and decorative assembly 310 of FIG. 8, but in the 400 series, such as tiles 416, picture support assembly 418, etc.

Figure 10:
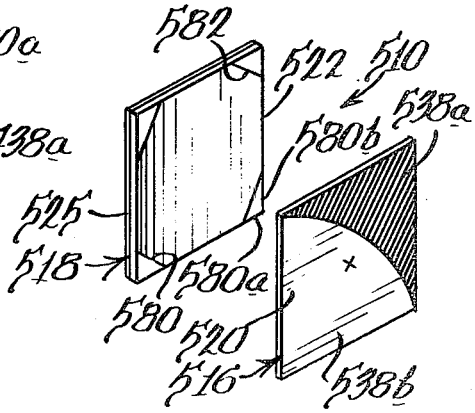
FIG. 10 is an exploded perspective view of another wall hanging illustrative a backing member with triangular flaps secured thereon which define triangular pockets for receiving the corners of a flexible tile.

The wall hanging and decorative assembly 510 of FIG. 10 is similar to the wall hanging and decorative assembly 410 of FIG. 9, except that the backing surface 522 has triangular flaps 580 mounted thereon, in lieu of Velcro-type fasteners 470*a* and 470*b* (FIG. 9). Triangular flaps 580 cooperate with backing surface 522 to define triangular pockets 582 for receiving the corners of the generally flat or planar, flexible tiles 516. Specifically, there are four triangular flaps 580 aligned in registration with the corners of each tile 516. Each triangular flap 580 is made out of transparent flexible plastic, such as cellulose acetate, with its sides 580*a* and 580*b* glued or otherwise fastened to backing surface 522. For ease of understanding and comparision, similar parts and components of the wall hanging and decorative assembly 510 shown in FIG. 10 have been given numbers similar to the corresponding parts and components of the wall hanging and decorative assembly 410 of FIG. 9, but in the 500 series, such as tiles 516, picture support assembly 518, etc.

In some circumstances it may be desirable that the wall hanging and decorative assembly have tiles which are made of self-sticking or adhering flexible plastic, which can be secured to the backing member without the use of triangular flaps, Velcro-type fasteners or magnets.

The preferred forms of the wall hangings of the present invention all have a frame as in FIG. 1 and can be hung in the living room, dining room, kitchen, bedroom or other rooms in the home, in hospitals, restaurants, hotels, offices, classrooms, etc. Several wall hangings can be hung together in groups. In some circumstances, however, such as for aesthetic reasons or for other purposes, it may be desirable to omit the frame.

If desired, the variable pictures can be completely replaced with a new set of tiles. The variable pictures can be of geometric designs, optical illusions, assorted animals, landscape scenes, portraits of famous individuals, art reproductions, facsimiles, etc.

The preceding description has been given for ease of understanding only. No unnecessary limitations are to be understood therefrom as modifications will be obvious to those skilled in the art.

What is claimed is:

1. A wall hanging, comprising:

a selectively variable picture having a plurality of movable tile means positioned generally adjacent each other in a longitudinal and lateral array, said tile means having complementary configurations and being interchangeable;

each tile means having a single thin walled viewable picture surface facing generally forward with a peripheral edge and having a thin walled skirt extending generally rearwardly from said periphery edge, said thin walled skirt having a rearward edge and a rearward dimension defining the thickness of said tile means;

said viewable picture surface being generally planar and spanning a distance substantially greater than the thickness of said tile means and defining a geometric center;

at least one eccentric image positioned generally adjacent said viewable picture surface at a location geometrically offset and spaced from said geometric center;

each of said tile means being movable for selectively varying the position of said eccentric image to attain a different picture;

said thin walled skirt cooperating with said viewable picture surface for defining a rearwardly facing socket positioned generally rearwardly of said viewable picture surface, said socket having a minimum cross-sectional area slightly less than the maximum surface area of said viewable picture surface and having a lateral shape and configuration substantially similar to the shape and configuration of said viewable picture surface;

said thin walled skirt and said thin walled viewable surface having wall thicknesses substantially less than the minimum distance across said socket for minimizing the weight and amount of material needed to fabricate said tile means;

picture support means generally covered by and positioned rearwardly of said selectively variable picture for supporting said selectively variable picture on a wall, said picture support means having a generally planar backing surface positioned generally parallel to said viewable picture surfaces for supportingly engaging said rearward edges of said tile means and having a plurality of complementary configured pegs having a configuration generally complementary and similar to said tile means, said pegs extending forwardly from said backing surface generally towards said viewable picture surfaces and aligned in registration with said sockets for matingly engaging said tile means;

each of said pegs having a front surface and side wall means extending between and connecting said front surface to said backing surface, said side wall means engaging said skirt and extending forwardly a sufficient distance to position said front surface closely adjacent said viewable picture surface;

said front surface being generally planar and spanning a distance substantially greater than said forward distance of said side wall means, and said front surface being positioned generally parallel to and rearwardly of said viewable picture surface; and frame means connected to and extending outwardly of said picture support means for decoratively surrounding and containing said selectively variable picture.

2. A wall hanging in accordance with claim 1 wherein:

said tile means include a decorative member removably positioned within said socket between and adjacent said viewable picture surface and said front surface, said decorative member having a shape and configuration generally similar to said viewable picture surface and lying generally parallel to said viewable picture surface;

said decorative member having a viewable decorative surface positioned generally forwardly and against said viewable picture surface and substantially covering said viewable picture surface as viewed from said backing surface;

said eccentric image being positioned substantially eccentrically on said viewable decorative surface and facing towards said viewable picture surface; and said viewable picture surface being substantially transparent for providing a window-like protective covering over said decorative member to protectively cover said decorative member and permit said decorative member to be viewed.

3. A wall hanging in accordance with claim 2 wherein:

said decorative member has a second viewable decorative surface normally positioned against and facing said front surface of said peg, said decorative member being reversible for positioning said second viewable decorative surface generally forward and against said transparent viewable picture surface, and said tile means includes a second eccentric image positioned substantially eccentrically on said second viewable decorative surface.

4. A wall hanging in accordance with claim 1 wherein:

each of said complementary configured pegs are generally rectangular for substantially preventing longitudinal and lateral movement of said tile means, said rectangular pegs having a generally rectangular front surface and side walls with a generally rectangular cross-sectional configuration, said rectangular front surface having a length and width substantially greater than the forward distance of said side walls;

said rectangular front surface cooperating with said side walls to define a generally concave corner providing an arcuate fulcrum for facilitating removal of said tile means;

each of said tile means being generally rectangular and having a generally rectangular viewable picture surface and a skirt with a generally rectangular cross-sectional configuration, and said socket having a generally rectangular cross-sectional configuration for slidably receiving and telescopically engaging said rectangular peg;

said rectangular picture surface having a length and a width substantially greater than the rearward dimension of said skirt, and said rectangular picture surface having a manually depressible corner substantially covering and aligned with said concave corner, said manually depressible corner being depressible toward said backing surface for pivotally engaging said arcuate fulcrum and removing said tile means from said peg.

5. A wall hanging in accordance with claim 1 wherein:

each of said tile means is generally cylindrical;

said cylindrical tile means has a generally circular viewable picture surface and an annular skirt and said socket is generally cylindrical for rotatably receiving said peg, said circular viewable picture surface being of a diameter substantially greater than the thickness of said tile means;

each of said pegs is generally cylindrical and has a general circular front surface and an annular side wall, said circular front surface being of a diameter substantially greater than the forward distance of said annular side wall; and said cylindrical tile means are spaced apart from each other for permitting said tiles to freely rotate upon said pegs for selectively varying said picture.

6. A decorative assembly, comprising:

a selectively variable picture having a plurality of movable tile means positioned generally adjacent each other in a longitudinal and lateral array, said tile means being substantially of the same size and shape and being interchangeable;

each tile means having a viewable picture surface facing generally forward and having a thickness extending in the rearward direction, said viewable picture surface spanning a distance substantially greater than said thickness and defining a geometric center;

at least one eccentric image positioned generally adjacent said viewable picture surface at a location generally spaced from said geometric center;

picture support means generally covered by and positioned rearwardly of said selectively variable picture, said picture support means having a generally planar backing surface positioned generally parallel to said viewable picture surfaces;

connector means for releasably connecting said tile means to said picture support means, said connector means including a plurality of pegs extending forwardly from said backing surface and rearwardly facing sockets defined by said tile means for snugly receiving said pegs, each of said sockets having a minimum cross-sectional area slightly less than the maximum surface area of the viewable picture surface of the tile means to which it is associated;

each of said tile means being removable and rotatably movable about the peg to which it is associated and interchangeable with one of the other tile means for selectively varying the position of said eccentric images to attain a different picture; and frame means connected to and extending outwardly of said picture support means for decoratively surrounding said selectively variable picture.

7. A decorative assembly in accordance with claim 6 wherein:

each of said tile means is generally rectangular; and said connector means include a plurality of generally rectangular pegs extending integrally forwardly from said backing surface, and rearwardly facing sockets defined by said tile means and having a generally rectangular cross-sectional configuration for snugly receiving said pegs, and said rectangular pegs cooperating with said rectangular sockets for substantially preventing longitudinal and lateral movement of said tile means; and each of said rectangular pegs defines a generally concave corner providing an arcuate fulcrum for pivotally engaging one of said tile means and facilitating removal of said tile means.

8. A decorative assembly in accordance with claim 6 wherein:

said viewable picture surface of said tile means is substantially transparent and positioned forwardly of said rearwardly facing socket and said peg to which it is associated, said tile means include a decorative member positioned between and adjacent said transparent viewable picture surface and said picture support means, said tile means being positioned forwardly of said peg; and said eccentric image is positioned eccentrically on said decorative member and faces generally towards said viewable picture surface.

9. A decorative assembly in accordance with claim 6 wherein:

each of said tile means are generally cylindrical;

said cylindrical tile means have a generally circular viewable picture surface with a circumferential edge and have a generally annular skirt extending rearwardly from said circumferential edge; and said connector means includes a plurality of generally cylindrical pegs extending integrally forward from said backing surface, and generally cylindrical sockets defined by said cylindrical tile means and facing generally rearwardly for matingly receiving said cylindrical pegs, and said tile means being rotatable on said pegs for selectively varying the position of said eccentric images to attain different pictures.

10. A wall hanging, comprising:

a selectively variable picture having a plurality of generally rectangular, movable tile means positioned generally adjacent each other in a longitudinal and lateral array, said tile means being substantially of the same size and being interchangeable;

each tile means having a single thin walled viewable picture surface facing generally forward with a generally rectangular peripheral edge and having a thin walled skirt with a generally rectangular cross-sectional configuration extending generally rearwardly from said periphery edge, said skirt having a rearward edge and a rearward dimension defining the thickness of said tile means;

said viewable picture surface being generally planar and having a length and a width substantially greater than the thickness of said tile means, said viewable picture surface having four corners and defining a geometric center;

at least one eccentric image positioned generally adjacent said viewable picture surface at a location geometrically offset and spaced from said geometric center;

said thin walled skirt cooperating with said viewable picture surface for defining a rearwardly facing socket positioned generally rearwardly of said viewable picture surface, said rearwardly facing socket having a generally rectangular cross-sectional area slightly less than the maximum surface area of said viewable picture surface;

said thin walled skirt and said thin walled viewable picture surface having wall thicknesses substantially less than the minimum distance across said socket for minimizing the weight and amount of material needed to fabricate said tile means;

picture support means generally covered by and positioned rearwardly of said selectively variable picture for supporting said selectively variable picture on a wall, said picture support means having a generally planar backing surface positioned generally parallel to said viewable picture surfaces for supportingly engaging said rearward edges of said tile means and having a plurality of generally rectangular pegs extending forwardly from said backing surface generally towards said viewable picture surfaces and aligned in registration with the sockets of said tile means for snap-fittingly interlocking engagement with said tile means to substantially prevent longitudinal and lateral movement of said tile means;

each of said pegs having a generally rectangular front surface and side walls having a generally rectangular cross-sectional configuration extending between and connecting said front surface to said backing surface, said side walls engaging said skirt and extending forwardly a sufficient distance to position said front surface closely adjacent said viewable picture surface;

said front surface being generally planar and having a length and a width substantially greater than the forward distance of said side walls, said front surface being positioned generally parallel to and rearwardly of said viewable picture surface;

said front surface cooperating with said side walls to define a generally concave corner aligned generally rearwardly of one of said corners of said viewable picture surface for facilitating removal of the tile means to which it is associated, said concave corner providing an arcuate fulcrum for pivotally engaging and removing said tile means in response to depressing said one of said corners rearwardly;

said tile means being removable from said peg and being rotatable to four different coplanar positions spaced about 90 degrees from each other for varying the location of said eccentric image and attaining different pictures; and frame means connected to and extending outwardly of said picture support means for decoratively surrounding and containing the tile means of said selectively variable picture.

11. A wall hanging in accordance with claim 10 wherein:

said tile means include a generally rectangular decorative member removably positioned within said socket between and adjacent said viewable picture surface and said front surface, said decorative member lying generally parallel to said viewable picture surface and substantially covering said viewable picture surface as viewed from said backing surface;

said decorative member having a viewable decorative surface positioned generally forwardly and against said viewable picture surface;

said eccentric image being positioned subtantially eccentrically on said viewable decorative surface and facing towards said viewable picture surface; and said viewable picture surface being substantially transparent for providing a window-like protective covering over said decorative member to protectively cover said decorative member and permit said decorative member to be viewed.

12. A wall hanging in accordance with claim 11 wherein:

said decorative member has a second viewable decorative surface normally positioned against and facing said front surface of said peg, said decorative member being reversible for positioning said second viewable decorative surface generally forward and against said transparent viewable picture surface, and said tile means includes a second eccentric image positioned substantially eccentrically on said second viewable decorative surface.

13. A wall hanging, comprising:

a selectively variable picture having a plurality of generally cylindrical tile means spaced generally adjacent each other in a longitudinal and lateral array, said tile means being rotatable and interchangeable;

each tile means having a generally circular thin walled viewable picture surface facing generally forward with a circumferential edge and having an annular thin walled skirt extending generally rearwardly from said circumferential edge, said skirt having a rearward edge and a rearward dimension defining the thickness of said tile means;

said viewable picture surface being generally planar with a diameter substantially greater than the thickness of said tile means and defining a geometric center;

said thin walled skirt cooperating with said viewable picture surface for defining a rearwardly facing socket positioned generally rearwardly of said viewable picture surface, said rearwardly facing socket having a generally circular cross-sectional area slightly less than the maximum surface area of said viewable picture surface and having a generally cylindrical configuration;

said thin walled skirt and said thin walled viewable picture surface having wall thicknesses substantially less than the diameter across said socket for minimizing the weight and amount of material needed to fabricate said tile means;

picture support means generally covered by and positioned rearwardly of said selectively variable picture for supporting said selectively variable picture on a wall, said picture support means having a generally planar backing surface positioned generally parallel to said viewable picture surfaces for supportingly engaging said rearward edges of said tile means and having a plurality of generally cylindrical pegs extending forwardly from said backing surface generally towards said viewable picture surfaces and aligned in registration with the sockets for matingly engaging said tile means;

each of said pegs having a generally circular front surface and an annular side wall extending between and connecting said front surface to said backing surface, said side wall engaging said skirt and extending forwardly a sufficient distance to position said front surface closely adjacent said viewable picture surface;

said front surface being generally planar and being of a diameter substantially greater than said forward distance of said annular side wall, and said front surface being positioned generally parallel to and rearwardly of said viewable picture surface;

said tile means being rotatable on said pegs for selectively varying the positions of said eccentric images to attain different pictures; and frame means connected to and extending outwardly of said picture support means for decoratively surrounding said selectively variable picture.

14. A wall hanging in accordance with claim 13 wherein:

said tile means includes a generally circular decorative member removably positioned within said socket between and adjacent said viewable picture surface and said front surface, said decorative member lying generally parallel to said viewable picture surface and substantially covering said viewable picture surface as viewed from said backing surface;

said decorative member having a viewable decorative surface positioned generally forwardly and against said viewable picture surface;

said eccentric image being positioned substantially eccentrically on said viewable decorative surface and facing towards said viewable picture surface; and said viewable picture surface being substantially transparent for providing a window-like protective covering over said decorative member to protectively cover said decorative member and permit said decorative member to be viewed.

15. A wall hanging in accordance with claim 14 wherein:

said decorative member has a second viewable decorative surface normally positioned against and facing said front surface of said peg, said decorative member being reversible for positioning said second viewable decorative surface generally forward and against said transparent viewable picture surface, and said tile means includes a second eccentric image positioned substantially eccentrically on said second viewable decorative surface.

16. A decorative assembly, comprising:

a selectively variable picture having a plurality of movable tile means positioned generally adjacent each other in a longitudinal and lateral array, said tile means having complementary configurations and being interchangeable;

each tile means having a single thin walled viewable picture surface facing generally forward with a peripheral edge and having a thin walled skirt extending generally rearwardly from said periphery edge, said thin walled skirt having a rearward edge and a rearward dimension defining the thickness of said tile means;

said viewable picture surface spanning a distance substantially greater than the thickness of said tile means and defining a geometric center;

at least one eccentric image positioned generally adjacent said viewable picture surface at a location geometrically offset and spaced from said geometric center;

each of said tile means being movable for selectively varying the position of said eccentric image to attain a different picture;

said thin walled skirt cooperating with said viewable picture surface for defining a rearwardly facing socket positioned generally rearwardly of said viewable picture surface, said socket having a minimum cross-sectional area slightly less than the maximum surface area of said viewable picture surface and having a lateral shape and configuration substantially similar to the shape and configuration of said viewable picture surface;

said thin walled skirt and said thin walled viewable surface having wall thicknesses substantially less than the minimum distance across said socket for minimizing the weight and amount of material needed to fabricate said tile means;

picture support means generally covered by and positioned rearwardly of said selectively variable picture for supporting said selectively variable picture, said picture support means having a backing surface positioned generally parallel to said viewable picture surfaces for supportingly engaging said rearward edges of said tile means and having a plurality of complementary configured pegs having a configuration generally complementary and similar to said tile means, said pegs extending forwardly from said backing surface generally towards said viewable picture surfaces and aligned in registration with said sockets for matingly engaging said tile means;

each of said pegs having a front surface and side wall means extending between and connecting said front surface to said backing surface, said side wall means engaging said skirt and extending forwardly a sufficient distance to position said front surface closely adjacent said viewable picture surface; and said front surface spanning a distance substantially greater than said forward distance of said side wall means and being positioned generally rearwardly of said viewable picture surface.

17. A wall hanging in accordance with claim 16 wherein:

said tile means include a decorative member removably positioned within said socket between and adjacent said viewable picture surface and said front surface, said decorative member having a shape and configuration generally similar to said viewable picture surface and lying generally parallel to said viewable picture surface;

said decorative member having a viewable decorative surface positioned generally forwardly and against said viewable picture surface and substantially covering said viewable picture surface as viewed from said backing surface;

said eccentric image being positioned substantially eccentrically on said viewable decorative surface and facing towards said viewable picture surface; and said viewable picture surface being substantially transparent for providing a window-like protective covering over said decorative member to protectively cover said decorative member and permit said decorative member to be viewed.

18. A wall hanging in accordance with claim 17 wherein:

said decorative member has a second viewable decorative surface normally positioned against and facing said front surface of said peg, said decorative member being reversible for positioning said second viewable decorative surface generally forward and against said transparent viewable picture surface, and said tile means includes a second eccentric image positioned substantially eccentrically on said second viewable decorative surface.

19. A wall hanging in accordance with claim 16 wherein:

each of said complementary configured pegs are generally rectangular for substantially preventing longitudinal and lateral movement of said tile means, said rectangular pegs having a generally rectangular front surface and side walls with a generally rectangular cross-sectional configuration, said rectangular front surface having a length and width substantially greater than the forward distance of said side walls;

said rectangular front surface cooperating with said side walls to define a generally concave corner providing an arcuate fulcrum for facilitating removal of said tile means;

each of said tile means being generally rectangular and having a generally rectangular viewable picture surface and a skirt with a generally rectangular cross-sectional configuration, and said socket having a generally rectangular cross-sectional configuration for slidably receiving and telescopically engaging said rectangular peg;

said rectangular picture surface having a length and a width substantially greater than the rearward dimension of said skirt; and said rectangular picture surface having a manually depressible corner substantially covering and aligned with said concave corner, said manually depressible corner being depressible toward said backing surface for pivotally engaging said arcuate fulcrum and removing said tile means from said peg.

20. A wall hanging in accordance with claim 16 wherein:

each of said tile means is generally cylindrical;

each cylindrical tile means has a generally circular viewable picture surface and an annular skirt and said socket is generally cylindrical for rotatably receiving said peg, said circular viewable picture surface being of a diameter substantially greater than the thickness of said tile means;

each of said pegs is generally cylindrical and has a general circular front surface and an annular side wall, said circular front surface being of a diameter substantially greater than the forward distance of said annular side wall; and said cylindrical tile means are spaced apart from each other for permitting said tiles to freely rotate upon said pegs for selectively varying said picture.

21. A decorative assembly, comprising:

a selectively variable picture having a plurality of movable tile means positioned generally adjacent each other in a longitudinal and lateral array, said tile means being substantially of the same size and shape and being interchangeable;

each tile means having a viewable picture surface facing generally forward and having a thickness extending in the rearward direction, said viewable picture surface spanning a distance substantially greater than said thickness and defining a geometric center;

at least one eccentric image positioned generally adjacent said viewable picture surface at a location generally spaced from said geometric center;

each of said tile means being movable for selectively varying the position of said eccentric images to attain a different picture;

picture support means generally covered by and positioned rearwardly of said selectively variable picture, said picture support means having a generally planar backing surface positioned generally parallel to said viewable picture surfaces;

connector means for releasably connecting said tile means to said picture support means;

frame means connected to and extending outwardly of said picture support means for decoratively surrounding said selectively variable picture;

each of said tile means being generally rectangular;

said connector means including a plurality of generally rectangular pegs extending integrally forwardly from said backing surface; and rearwardly facing sockets defined by said tile means and having a generally rectangular cross-sectional configuration for snugly receiving said pegs, and said rectangular pegs cooperating with said rectangular sockets for substantially preventing longitudinal and lateral movement of said tile means; and each of said rectangular pegs defining a generally concave corner providing an arcuate fulcrum for pivotally engaging one of said tile means and facilitating removal of said tile means.

22. A decorative assembly, comprising:

a selectively variable picture having a plurality of movable tile means positioned generally adjacent each other in a longitudinal and lateral array, said tile means being substantially of the same size and shape and being interchangeable;

each tile means having a viewable picture surface facing generally forward and having a thickness extending in the rearward direction, said viewable picture surface spanning a distance substantially greater than said thickness and defining a geometric center;

at least one eccentric image positioned generally adjacent said viewable picture surface at a location generally spaced from said geometric center;

each of said tile means being movable for selectively varying the position of said eccentric images to attain a different picture;

picture support means generally covered by and positioned rearwardly of said selectively variable picture, said picture support means having a generally planar backing surface positioned generally parallel to said viewable picture surfaces;

connector means for releasably connecting said tile means to said picture support means;

frame means connected to and extending outwardly of said picture support means for decoratively surrounding said selectively variable picture;

each of said tile means being generally cylindrical;

said cylindrical tile means having a generally circular viewable picture surface with a circumferential edge and having a generally annular skirt extending rearwardly from said circumferential edge; and said connector means including a plurality of generally cylindrical pegs extending integrally forward from said backing surface, and generally cylindrical sockets defined by said cylindrical tile means and facing generally rearwardly for matingly receiving said cylindrical pegs; and said tile means being rotatable on said pegs for selectively varying the position of said eccentric images to attain different pictures.

* * * * *

UNITED STATES PATENT AND TRADEMARK OFFICE

CERTIFICATE OF CORRECTION

PATENT NO. : 4,177,305

DATED : December 4, 1979

INVENTOR(S) : David Feingold and Susan Feingold

It is certified that error appears in the above-identified patent and that said Letters Patent are hereby corrected as shown below:

Column 1, line 42; "block" should be --blocks--;

Column 1, line 61; "confined" should be --configured--;

Column 2, line 27; "thickness" should be --thicknesses--;

Column 2, line 30; "blocking" should be --backing--;

Column 2, line 59; "and" should be --are--;

Column 3, line 24; "typed" should be --type--;

Column 5, line 19; "(FIG. 3)" should be --FIG. 3)--;

Column 7, line 8; insert --surface-- after "picture";

Column 7, line 26; "cross-section" should be --cross-sectional--;

Column 7, line 29; insert --surface--after "picture";

Column 7, line 30; "thicknees" should be --thickness--.

Signed and Sealed this

*Eighteenth* Day of *March 1980*

[SEAL]

*Attest:*

SIDNEY A. DIAMOND

*Attesting Officer*

*Commissioner of Patents and Trademarks*